US008597166B2

(12) United States Patent
Klein

(10) Patent No.: US 8,597,166 B2
(45) Date of Patent: Dec. 3, 2013

(54) FITNESS APPARATUS AND PRODUCTION METHOD THEREOF

(76) Inventor: Frank Klein, Munich (DE)

( * ) Notice: Subject to any disclaimer, the term of this patent is extended or adjusted under 35 U.S.C. 154(b) by 289 days.

(21) Appl. No.: 12/974,433

(22) Filed: Dec. 21, 2010

(65) Prior Publication Data

US 2011/0152044 A1 Jun. 23, 2011

(30) Foreign Application Priority Data

Dec. 23, 2009 (DE) ..... 10 2009 060 303

(51) Int. Cl.
*A63B 21/00* (2006.01)

(52) U.S. Cl.
USPC ..... 482/148; 482/106; 482/109; 482/108; 482/104

(58) Field of Classification Search
USPC ..... 482/52, 72, 142, 130, 54, 70, 71
See application file for complete search history.

(56) References Cited

U.S. PATENT DOCUMENTS

| | | | |
|---|---|---|---|
| 2002/0198476 | A1 | 12/2002 | Chen |
| 2007/0135275 | A1 | 6/2007 | Oates |
| 2009/0233772 | A1 | 9/2009 | Eck |

FOREIGN PATENT DOCUMENTS

| | | | |
|---|---|---|---|
| DE | 201 11 969 | U1 | 10/2001 |
| DE | 101 27 319 | A1 | 12/2002 |
| DE | 10328311 | A1 | 1/2005 |
| DE | 103 49 767 | A1 | 6/2005 |
| DE | 20221495 | U1 | 3/2006 |
| DE | 20 2005 020 652 | U1 | 5/2006 |
| DE | 20 2008 003 266 | U1 | 7/2008 |

OTHER PUBLICATIONS

Holger Oelschlager, European Search Report (untranslated copy provided), Feb. 7, 2011, EP Application No. 10 01 5836, 2 pages.

*Primary Examiner* — Jerome W Donnelly
(74) *Attorney, Agent, or Firm* — Hoffman Warnick LLC

(57) ABSTRACT

The present invention relates to a method for producing a fitness apparatus having the following components: a flexible bar which can be set in oscillation upon operation of the fitness apparatus by a user, a grip area arranged centrally on the flexible bar for the user to hold the fitness apparatus and end caps arranged at both ends of the flexible bar, wherein the method includes the following method steps: arranging at least one respective end weight at the ends of the flexible bar, inserting the flexible bar with the end weights arranged thereon into a first molding tool to form the end caps, foaming out of the first molding tool with a first foam material to produce at least the end caps and subsequent hardening of the first foam material. The invention also relates to a fitness apparatus produced in particular with the inventive method.

29 Claims, 1 Drawing Sheet

FITNESS APPARATUS AND PRODUCTION METHOD THEREOF

FIELD OF THE INVENTION

The present invention relates in a first aspect to a fitness apparatus including a flexible bar, which upon operation of the fitness apparatus by a user, can be set in oscillation, a grip area arranged centrally on the flexible bar for the user to hold the fitness apparatus, and end caps arranged at both ends of the flexible bar.

According to a second aspect the invention relates to a method for producing such a fitness apparatus.

Apparatuses of this nature are known for example from DE 101 27 319 A1 and can be used for a multitude of exercises, some of which are described in DE 101 27 319 A1.

DE 103 49 767 A1 discloses a device and a method for producing such a training apparatus or fitness apparatus. An elastic bar is pushed through a grip element which is made of an elastic material, for example rubber. End caps, which can likewise be made of rubber, are placed according to the prior art on the ends of the flexible bar and stuck there or fixed with appropriate securing devices. Such a securing device is described for example in DE 20 2005 020 652 U1.

SUMMARY OF THE INVENTION

An aspect of the present invention is directed to a fitness apparatus and a method for production thereof, wherein the end caps can be simply and securely fixed to the ends of the flexible bar.

Variants of the inventive method and advantageous embodiments of the inventive fitness apparatus are the subject matter of the dependent claims and are additionally described in the following description, in particular in association with the attached drawings.

A method in accordance with an embodiment includes:

(a) arranging respectively at least one end weight at the ends of the flexible bar;

(b) inserting the flexible bar with the end weights arranged thereon into a first moulding tool for moulding the end caps;

(c) foaming-out of the first moulding tool with a first foam material to produce at least the end caps; and (d) subsequent hardening of the first foam material.

The fitness apparatus of the above type is further developed according to the invention in that at least one end weight is arranged at each of the ends of the flexible bar, the end weight being at least partially enclosed or surrounded by the end cap, in that the end caps are made of a first foam material, and in that the grip area is made of a second foam material.

In the preliminary work leading to the present invention it was initially recognised that the arrangement of the end caps requires comparatively high resources in the conventional fitness apparatuses of the above type.

It can be seen as a first idea of the present invention to produce the end caps no longer as separate parts, for example from rubber, as was the case thus far, which end caps are then placed on the flexible bar. Instead, in the present invention, the end caps are produced directly at the ends of the flexible bar, namely being formed using a foaming process. In this way a particularly reliable and secure connection of the end caps to the ends of the flexible bar can be achieved.

Various advantages of the present invention, besides the particularly good material connection and fixing, are also that particularly light apparatuses can be produced through the foamed end pieces and possibly also grip elements.

With the fitness apparatuses of the invention the end caps form a solid connection with the bar in the form of a bonded or glued joint after the foam material has hardened or cured.

If the gripping portion, too, is formed of a foam material, in particular the same foam material as the end caps, this will also be the case for the gripping portion; e.g., the gripping portion will form a solid connection with the bar in the form of a bonded or glued joint after the foam material has hardened or cured.

In an embodiment, the first moulding tool can be pivoted at least partially simultaneously, thus at least in a certain phase, during the foaming. A particularly even distribution of the foam material and the entrapped air can hereby be achieved.

The moulding tool can be pivoted during virtually the whole foaming phase, that is to say it is purposefully moved to and fro.

In principle any material can be used as a first foaming material, the material having the appropriate properties with regard to the weight properties and adhesion properties to the surface of the flexible bar. A thermosetting plastic, for example, polyurethane, can be used as the first foam material.

The flexible bar can in principle be any elongated or rod-shaped element which has the desired properties having regard to the external dimensions and the elastic properties, thus the oscillation properties. For example, the flexible bar can be made of metal or also wood. In another embodiment, the flexible bar is made of a fibre composite material, in particular a glass fibre material.

In principle, there is also great freedom in relation to the cross-sectional form of the flexible bar. For example, in order to achieve symmetrical oscillation properties in relation to an axis of the flexible bar, flexible bars with circular cross-section can be used.

In principle the flexible bar can be divisible into two or even more parts. For example, the grip element or the grip area can be divisible using a screw connection or another connection. In an embodiment, the flexible bar is formed as one piece.

With regard to the end weights, which are arranged at the ends of the flexible bar, it is in principle only a matter of ensuring that, through these end weights together with the weight of the end caps made from the first foam material, the necessary weight for the correct oscillation properties is provided. In this respect the end weights can in principle be produced from any material. In an embodiment, the end weights can be made of metal and/or plastic.

A multitude of variants are possible for fixing of the end weights at the ends of the flexible bar. For example, the end weights can have a greater radius than the flexible bar itself in relation to an axis of the flexible bar, because a certain holding or fixing function in relation to the sprayed-on end cap is then achieved through the end weights themselves.

With regard to the oscillation properties of the fitness apparatus, the end caps, the grip area, and/or the end weights are can be formed rotationally symmetrically to an axis of the flexible bar. For example the end caps, the grip area, and/or the end weights can have a cylindrical form. In principle, however, other rotationally symmetrical forms are also possible. For example, the end caps can also have a conical form. For ergonomic reasons it may be preferable to provide the grip area and/or the end caps with rounded edges.

The end weights can be connected with the ends of the flexible bar through a shape-locking and/or force-locking connection. For example, the end weights can each have a through bore or a blind bore, into which the flexible bar is inserted. In principle it would also be possible to form the end weights with a centrally and axially arranged pin element which is then inserted into a bore arranged on the end face at the ends of the flexible bar. In particularly simple solutions the end weights can also be stuck alternatively or additionally to the ends of the flexible bar.

In particularly stable but nonetheless easy-to-produce variants, the flexible bar is fixed in the through bores or the blind bores of the end weights through a press fit.

In an embodiment, the end weights can be completely enclosed by the end caps.

With regard to the oscillation properties of the fitness apparatus, the grip area can be formed from a flexible material. One advantage is hereby achieved that during operation of the fitness apparatus the whole grip area, which can in particular comprise a cylinder form with axial through bore, can also oscillate and the fitness apparatus can swing particularly well on both sides of the grip element.

In principle, the grip area can be placed on the flexible bar using known methods. In an embodiment, the flexible bar is for this purpose inserted into a second moulding tool for moulding the grip area, the second moulding tool is foamed out with a second foam material to produce at least the grip area, and the second foam material subsequently hardens. This method step, wherein the grip area is likewise produced through a foaming process, can in principle take place before the production of the end caps or also thereafter. Particularly good properties with regard to weight and homogeneity of the material distribution are achieved for the grip area, in the same way as for the end caps, if the first and/or the second moulding tool is/are pivoted at least partially simultaneously during the foaming. In particular the second moulding tool can be pivoted during the whole foaming process, thus being purposefully moved to and fro.

In another embodiment, the end caps and the grip area can be simultaneously formed. The moulding tool is usefully moved to and fro or pivoted essentially during the whole foaming process also for the production of the grip element.

The first moulding tool and the second moulding tool can thereby be formed by one and the same moulding tool.

The first and the second foam material for the end caps or the grip area can be adapted and selected in a targeted way with regard to weight and elastic properties.

In an embodiment, the foams to be used as the first and/or second foam material form in the hardened state an extensively closed-pore surface. This has advantages with regard to cleaning ability, haptic aspects, and lifespan of the fitness apparatuses.

An advantage of the method variant wherein the grip area is also made from a foamed material is that the total weight of the fitness apparatus can hereby be significantly reduced. The fitness apparatus can hereby be formed up to 30% lighter. In this way an improved training effect is achieved. With a lighter fitness apparatus there is less training in the lifting and holding force, but instead vibration training is at the forefront.

A further advantage of lighter fitness apparatuses is that significant cost reductions can be achieved in dispatch. Finally the haptic aspects of the end caps and grip areas can be optimised. The foamed grip areas and end caps do not cause hardly any abrasion on walls and floors, do not smell and contain hardly any allergenic substances.

In an embodiment, the same foam material as the first foam material for the end caps can be used as a second foam material for the grip area.

The end caps and the grip area can usefully be simultaneously formed on the flexible bar.

Using the inventive method, the total weight of the fitness apparatuses and the geometric dimensions can be set extremely variably in relation to the desired values.

In an embodiment, the end weights can have a weight of about 65 g to about 125 g, or more preferably about 80 g to about 110 g, or particularly preferably about 90 g to 100 g. In principle the weights of the end weights are set in dependence upon the desired oscillation frequency and, associated therewith, in dependence upon the hardness of the bar. In this connection oscillation frequencies of a few Hertz, for example around 4 Hertz, can be achieved.

In an embodiment, the flexible bar can have a length of about 145 cm to about 175 cm, preferably about 150 cm to about 170 cm, and more preferably about 155 cm to about 165 cm.

In embodiment, the whole fitness apparatus can have a total weight of about 480 g to about 680 g, preferably about 480 g to about 580 g, and in particular about 480 g to about 520 g.

The effectiveness of the inventive method can be increased if a plurality of flexible bars for a plurality of fitness apparatuses are inserted into one moulding tool and for the plurality of these fitness apparatuses the end caps are simultaneously formed at least at one end of the flexible bars of the fitness apparatuses. In principle, method variants are also possible and advantageous here, wherein for a plurality of flexible bars both the end caps at both ends of the flexible bars and also the grip areas are simultaneously moulded in one and the same moulding tool which is pivoted during the foaming process.

A particularly fixed, stable and lasting connection between the end caps and the flexible bar and/or between the grip area and the flexible bar can be achieved if the foam material of the end caps and/or the foam material of the grip area is at least partially, preferably extensively, for example on about 70% to about 90% of the contact area, directly connected with an unpainted surface of the flexible bar.

In order to facilitate this, in an advantageous variant of the inventive method, the flexible bar is only painted after the arrangement of the grip area and/or after the arrangement of the end caps.

Method variants can also be advantageous wherein the bars are painted before the inventive moulding of the end caps and/or the grip area. The contact points for the end caps and/or the grip area are then spared during the painting. The painting can be carried out in such a way that the end caps and/or the grip area overlap the painted points of the bar slightly, for example about 1 cm to about 2 cm in axial direction, so that in the finished apparatus no unpainted points are visible. Nonetheless, a good adhesion of the end caps and/or the grip area at the unpainted points can still be guaranteed.

The subject matter of the invention is in particular a fitness apparatus which is produced according to the inventive method.

In an embodiment of the inventive fitness apparatus a thermosetting plastic, for example, polyurethane, can used as the first foam material.

In an embodiment of the inventive fitness apparatus the flexible bar can be formed from a fibre composite material, for example, from a glass fibre material.

In an embodiment of the inventive fitness apparatus, the end weights can be made of metal and/or plastic.

In an embodiment of the inventive fitness apparatus, the end weights can each have a through bore or a blind bore, into which the flexible bar is inserted.

In an embodiment of the inventive fitness apparatus the flexible bar can advantageously be fixed in the through bores or the blind bores of the end weights through a press fit.

The end weights can have a cylinder form in the inventive fitness apparatus. The grip area is preferably formed in the inventive fitness apparatus from a flexible material.

In the inventive fitness apparatus the grip area can advantageously be formed from the same foam material as the end caps.

The end caps and/or the grip area can advantageously be formed in the inventive fitness apparatus rotationally symmetrically to an axis of the flexible bar.

In the inventive fitness apparatus the end weights can advantageously have a weight of about 65 g to about 125 g, preferably about 80 g to about 110 g, and particularly preferably about 90 g to about 100 g.

In the inventive fitness apparatus the flexible bar can advantageously have a length of about 145 cm to about 175 cm, preferably about 150 cm to about 170 cm, particularly preferably about 155 cm to about 165 cm.

The inventive fitness apparatus can advantageously have a total weight of about 480 g to about 680 g, preferably about 480 g to about 580 g, and particularly preferably about 480 g to about 520 g.

The foam material of the end caps and/or the foam material of the grip area can advantageously be connected to an unpainted surface of the flexible bar in the inventive fitness apparatus.

BRIEF DESCRIPTION OF THE DRAWINGS

Further advantages and features of the invention are explained below by reference to the attached drawings.

DETAILED DESCRIPTION OF THE INVENTION

Figure 1:
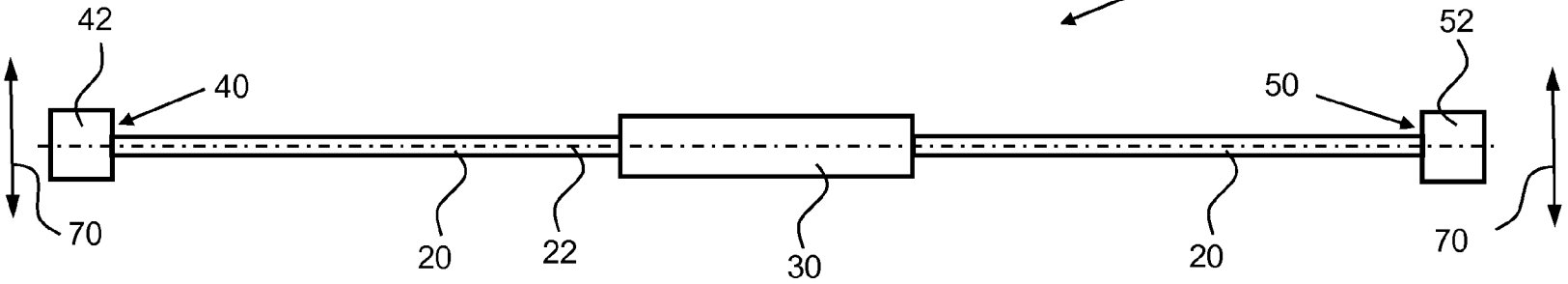
FIG. 1 shows in a schematic view an inventive fitness apparatus.

FIG. 1 illustrates an embodiment of an inventive fitness apparatus 10, produced in particular with the inventive method, which includes a flexible bar 20 with a grip area 30 arranged thereon. At a first end 40 of the flexible bar 20 there is a first end cap 42 and at a second end 50 of the flexible bar 20 there is a second end cap 52. In the example shown, both the grip area 30 and also the first end cap 42 and the second end cap 52 respectively have a cylindrical form, and are orientated coaxially with an axis 22 of the flexible bar 20.

The grip area 30 serves for holding the fitness apparatus 10 in one hand or also with both hands. In order to carry out exercises, the fitness apparatus 10 is then set in oscillation in such a way that the ends 40, 50 with the end caps 42, 52 arranged thereon swing symmetrically to and fro. The movement direction of the end caps 42, 52 during swinging is indicated by the double arrow 70.

Equivalent components are provided with the same reference numerals in all the drawings.

The inventive fitness apparatus 10 shown in FIG. 1 can be produced in particular with the inventive method.

Figure 2:
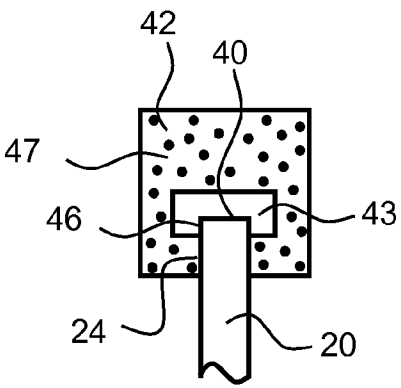
FIG. 2 shows in a sectional partial view an end region of a first example of an inventively produced fitness apparatus.

FIG. 2 shows in a sectional partial view a first example of an end cap 42 produced with the inventive method with an end weight 43 located therein which is connected to the flexible bar 20.

In order to carry out the inventive method, two metal plates are provided with a blind bore 46 for example for each fitness apparatus 10. For example, these metal plates, which constitute the end weights 43, can be produced through rotation.

FIG. 2 shows schematically an end weight 43 with the blind bore 46 arranged therein. In an embodiment, the weight of the end weights 43 is thereby purposefully set to approximately 96 g per end weight 43. The end weights 43 are then pressed onto the ends 40, 50 of the flexible bar 20. This is necessary in order to achieve the weight of the ends 40, 50 of the fitness apparatus 10 which is decisive for the oscillation properties. Through the foamed end caps 42, 52 alone the right weight could not be achieved. Before carrying out the foaming process the surfaces to be coated on the flexible bar 20 should be extensively, preferably completely, free of plastics, that is to say in particular free of grease, dirt and/or dye residue. In particular the flexible bar should in any case not be painted on at least the majority of the corresponding points.

The end cap 42 consists in its volume of the foamed-up foam material 47. In an embodiment, the foam material comprises, for example, polyurethane. In principle, however, other foam materials can also be used. As can also be seen from FIG. 2 and FIG. 3, the foam material 47 surrounds the end weight 43 and an end area of the bar 20. After hardening, the foam material 47 connects securely with the, preferably unpainted, surface 24 of the bar 20 so that the end cap 42 is overall held securely at the ends 40, 50 of the bar.

The flexible bar 20 is then placed with the weights 43 pressed thereon into the moulding tool. A polyurethane foam system is then foamed into the closed mould under pressure. The moulding tool is inventively pivoted during the foaming process. In this way an even distribution of the foam and air can be realised in a particularly advantageous way.

After the hardening of the foam material it will have assumed the shape defined by the moulding tool and also formed a fixed connection with the surface of the flexible bar 20, for example therefore with a painted surface.

In an embodiment, both the end caps 42, 52 and the grip area 30 can be foamed on the flexible bar 20 with one and the same moulding tool and with the same foam material.

After the hardening of the foam material and the removal of the fitness apparatus 10 from the moulding tool the fitness apparatus 10 only now needs to be cleaned to remove material residue and be tested in relation to its form.

Figure 3:
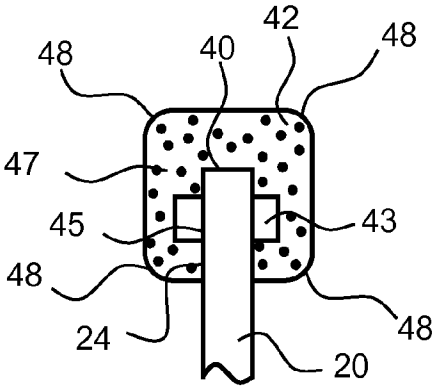
FIG. 3 in a sectional partial view an end region of a second example of an inventively produced fitness apparatus.

FIG. 3 shows an alternative variant, wherein the end weight 43 is provided with a through bore 45 and the flexible bar 20 is completely pushed through this end weight 43. In addition, the example shown in FIG. 3 differs from the variants of FIGS. 1 and 2 in that the edges 48 of the end cap 42 are rounded off. This has advantages in relation to the pleasant feel of the apparatus.

The present invention provides a new method for producing a fitness apparatus, wherein in an advantageous variant significantly lighter apparatuses and thus improved training possibilities can be achieved.

The invention claimed is:

1. A method for producing a fitness apparatus, the fitness apparatus comprising a flexible bar, which can be set in oscillation upon operation of the fitness apparatus by a user, a grip area arranged centrally on the flexible bar for the user to hold the fitness apparatus, and end caps arranged at both ends of the flexible bar, the method comprising:

arranging at least one respective end weight at the ends of the flexible bar;

inserting the flexible bar with the end weights arranged thereon into a first moulding tool to mould the end caps;

foaming out of the first moulding tool with a first foam material to produce at least the end caps; and subsequent hardening of the first foam material.

2. The method as defined in claim 1, further comprising:

at least partially simultaneously pivoting the first moulding tool during the foaming process.

3. The method as defined in claim 1, wherein the first foam material comprises a thermosetting plastic.

4. The method as defined in claim 3, wherein the thermosetting plastic comprises polyurethane.

5. The method as defined in claim 1, wherein the flexible bar comprises a fibre composite material.

6. The method as defined in claim 5, wherein the fibre composite material comprises a glass fibre material.

7. The method as defined in claim 1, wherein the end weights comprise at least one of: metal or plastic.

8. The method as defined in claim 1, wherein each end weight comprises a through bore or a blind bore, into which the flexible bar is inserted.

9. The method as defined in claim 8, further comprising:

fixing the flexible bar in the through bores or the blind bores of the end weights through a press fit.

10. The method as defined in claim 1, wherein the end weights have a cylindrical form.

11. The method as defined in claim 1, wherein the grip area comprises a flexible material.

12. The method as defined in claim 1, further comprising:

inserting the flexible bar into a second moulding tool to mould the grip area;

foaming out of the second moulding tool with a second foam material to produce at least the grip area; and subsequent hardening of the second foam material.

13. The method as defined in claim 12, further comprising:

at least partially simultaneously pivoting the second moulding tool during the foaming process.

14. The method as defined in claim 12, wherein the first moulding tool and the second moulding tool comprise the same moulding tool.

15. The method as defined in claim 12, wherein the first foam material for the end caps and the second foam material for the grip area comprise the same foam material.

16. The method as defined in claim 1, wherein the grip area is moulded simultaneously with the moulding of the end caps.

17. The method as defined in claim 1, wherein at least one of: the end caps and the grip area are formed rotationally symmetrically to an axis of the flexible bar.

18. The method as defined in claim 1, wherein the end weights have a weight of about 65 g to about 125 g.

19. The method as defined in claim 1, wherein the end weights have a weight of about 80 g to about 110 g.

20. The method as defined in claim 1, wherein the end weights have a weight of about 90 g to about 100 g.

21. The method as defined in claim 1, wherein the flexible bar has a length of about 145 cm to about 175 cm.

22. The method as defined in claim 1, wherein the flexible bar has a length of about 150 cm to about 170 cm.

23. The method as defined in claim 1, wherein the flexible bar has a length of about 155 cm to about 165 cm.

24. The method as defined in claim 1, wherein the fitness apparatus has a total weight of about 480 g to about 680 g.

25. The method as defined in claim 1, wherein the fitness apparatus has a total weight of about 480 g to about 580 g.

26. The method as defined in claim 1, wherein the fitness apparatus has a total weight of about 480 g to about 520 g.

27. The method as defined in claim 1, further comprising:

inserting a plurality of flexible bars for a plurality of fitness apparatuses into a moulding tool; and simultaneously forming the end caps at least at one end of the flexible bars of the fitness apparatuses.

28. The method as defined in claim 1, further comprising at least one of:

painting after producing the end caps; or painting after producing the grip area.

29. A method for producing a fitness apparatus, the fitness apparatus comprising a flexible bar, which can be set in oscillation upon operation of the fitness apparatus by a user; a grip area arranged centrally on the flexible bar for the user to hold the fitness apparatus; and end caps arranged at both ends of the flexible bar; wherein at least one respective end weight is arranged at the ends of the flexible bar and is enclosed by the end cap, wherein the end caps are produced from a first foam material, and wherein the grip area is produced from a second foam material, wherein the fitness apparatus is produced by:

arranging at least one respective end weight at the ends of the flexible bar;

inserting the flexible bar with the end weights arranged thereon into a first moulding tool to mould the end caps;

foaming out of the first moulding tool with the first foam material to produce at least the end caps; and subsequent hardening of the first foam material.

* * * * *